US005263711A

United States Patent [19]

Addis et al.

[11] Patent Number: 5,263,711

[45] Date of Patent: Nov. 23, 1993

[54] HOCKEY STICK WITH ADJUSTABLE BLADE

[76] Inventors: Jan Addis, 285 Oser Ave., Hauppauge, N.Y. 11788; Simon R. Mandell, 2 Village Dr. West, Dix Hills, N.Y. 11746

[21] Appl. No.: 930,321

[22] Filed: Aug. 14, 1992

[51] Int. Cl.[5] ..... A63B 59/14

[52] U.S. Cl. ..... 273/67 A; 273/79; 273/80.1

[58] Field of Search ..... 273/67 A, 80.1, 79, 273/80.2; 403/326, 327, 328, 116

[56] References Cited

U.S. PATENT DOCUMENTS

| | | | |
|---|---|---|---|
| 1,486,823 | 3/1924 | Allen | 273/79 |
| 2,661,952 | 12/1953 | Jackson | 273/80.1 |
| 3,102,726 | 9/1963 | Barrett | 273/80.1 |
| 3,206,206 | 9/1965 | Santosuosso | 273/80.1 |
| 3,430,957 | 3/1969 | Andis | 273/80.1 |
| 3,489,412 | 1/1970 | Franck et al. | 273/67 A |
| 4,736,951 | 4/1988 | Grant | 273/79 |

FOREIGN PATENT DOCUMENTS

| | | | |
|---|---|---|---|
| 1048806 | 8/1953 | France | 273/79 |
| 9169 | of 1909 | United Kingdom | 273/79 |

*Primary Examiner*—Mark S. Graham
*Attorney, Agent, or Firm*—Richard L. Miller

[57] ABSTRACT

A hockey stick with an adjustable blade is provided which consists of an elongated handle and a blade extending from a heel end to a toe end with at least one puck engaging surfaces extending between the ends. A structure is for pivoting the heel end of the blade about a lower portion of the elongated handle. A mechanism is for locking the blade in two angled opposite positions on the lower portion of the elongated handle. In a first instance, the hockey stick can be used by both a right handed and a left handed hockey player. In a second instance, a hockey player can make forehand and backhand puck striking shots from the at least one puck engaging surfaces of the blade.

2 Claims, 1 Drawing Sheet

HOCKEY STICK WITH ADJUSTABLE BLADE

BACKGROUND OF THE INVENTION

The instant invention relates generally to hockey sticks and more specifically it relates to a hockey stick with an adjustable blade.

Numerous hockey sticks have been provided in the prior art that are adapted to contain various shaped blades to enhance the forehand and backhand shots of the hockey players. For example, U.S. Pat. No. 3,563,546 to Dawe; U.S. Pat. No. 4,512,573 to Coolen; U.S. Pat. No. 4,664,379 to Melby; U.S. Pat. No. 4,793,613 to Hughes; Des. U.S. Pat. No. 263,329 to Clayton and Des. U.S. Pat. No. 264,863 to Walmsley all are illustrative of such prior art. While these units may be suitable for the particular purpose to which they address, they would not be as suitable for the purpose of the present invention as hereafter described.

SUMMARY OF THE INVENTION

A primary object of the present invention is to provide a hockey stick with an adjustable blade that will overcome the shortcomings of the prior art devices.

Another object is to provide a hockey stick with an adjustable blade that is pivotal at its heel end and has a locking mechanism built within its handle, so that the hockey stick can be conveniently used by either a right or left handed hockey player to accomplish various shots.

An additional specific object is to provide a hockey stick with an adjustable blade in which the hockey player can release the locking mechanism to pivot the blade, so that the hockey player can make forehand and backhand puck striking shots without having to turn the handle to do so.

A further object is to provide a hockey stick with an adjustable blade that is simple and easy to use.

A still further object is to provide a hockey stick with an adjustable blade that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
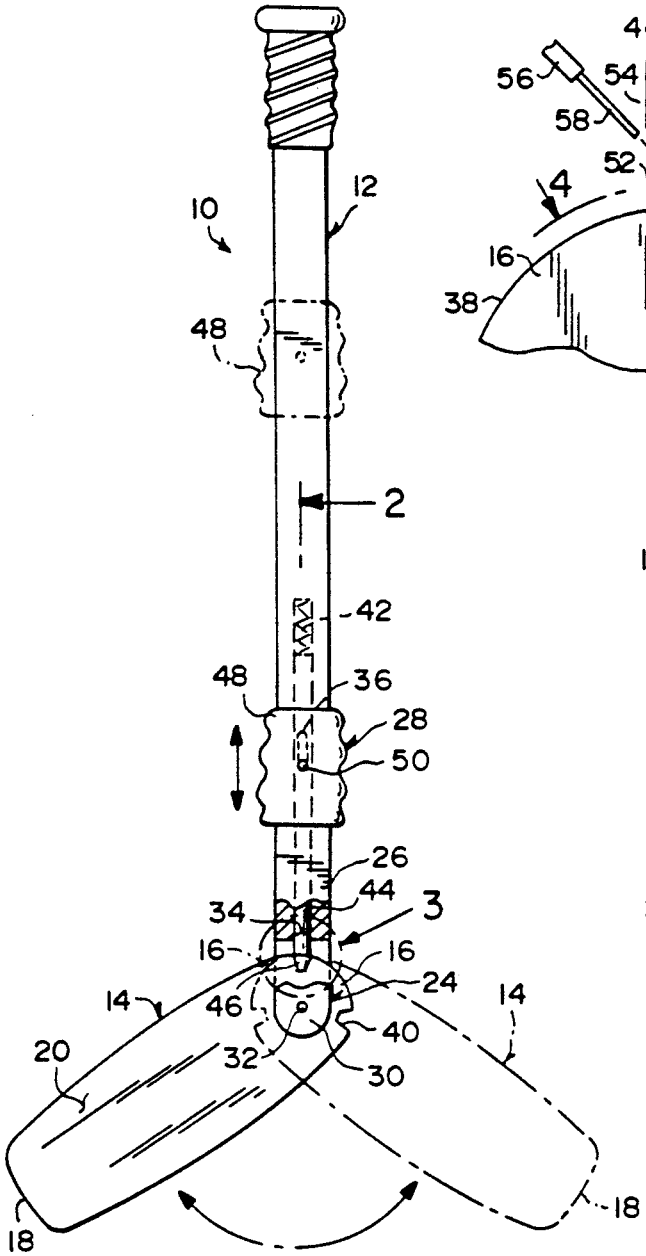
FIG. 1 is a diagrammatic side view with parts broken away shown in section of the instant invention.
Figure 2:
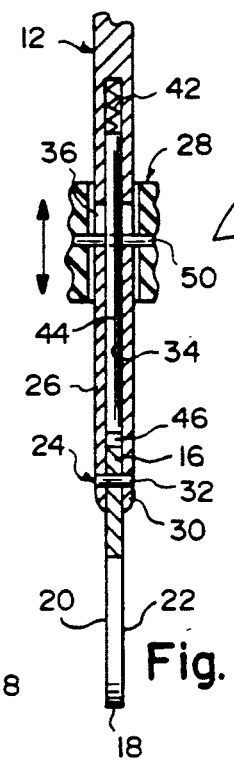
FIG. 2 is a cross sectional view taken on line 2—2 in FIG. 1.

Turning now descriptively to the drawings, in which similar reference characters denote similar elements throughout the several views, the Figures illustrate a hockey stick 10 with an adjustable blade which consists of an elongated handle 12 and a blade 14 extending from a heel end 16 to a toe end 18, with two opposite puck engaging surfaces 20 and 22 extending between the ends 16 and 18. A structure 24 is for pivoting the heel end 16 of the blade 14 about a lower portion 26 of the elongated handle 12. A mechanism 28 is for locking the blade 14 in two angled opposite positions on the lower portion 26 of the elongated handle 12.

In a first instance, the hockey stick 10 can be used by both a right handed and a left handed hockey player. In a second instance, a hockey player can make forehand and backhand puck striking shots from the two opposite puck engaging surfaces 20 and 22 of the blade 14, without having to turn the handle 12 to do so. It is to be noted that many hockey sticks have their puck engaging surfaces 20 or 22 curved in a particular manner such that only one side of the blade 14 is suitable for striking the puck. For blades so designed the instant invention 10 is particularly useful because it permits the properly designed surface to be the one that is always used to engaged the puck.

The pivoting structure 24 includes the lower portion 26 of the elongated handle 12 having a bifurcated end 30 and a pivot pin 32 mounted between the furcations of the bifurcated end 30 and the center of the heel end 16 of the blade 14.

The locking mechanism 28 consists of the elongated handle 12 having a central bore 34 extending inwardly from the bifurcated end 30 and a transverse slot 36 communicating with the central bore 34. The heel end 16 of the blade 14 has a curved edge 38 and two radially spaced apart tapered notches 40 therein. An expansion spring 42 is placed within the central bore 34 in the elongated handle 12. A cylindrical shaft 44 having a tapered end 46 is also placed within the central bore 34 in the elongated handle 12. The expansion spring 42 will bias the cylindrical shaft 44 towards the heel end 16 of the blade 14 so that the tapered end 46 will ride on the curved edge 38 and engage with either of the tapered notches 40. A hand grip 48 is slideable on the elongated handle 12. A rod 50 extends through the hand grip 48, the transverse slot 36 in the elongated handle 12 and the cylindrical shaft 44. The hockey player can slide the hand grip 48 away from the heel end 16 of the blade 14 to release the tapered end 46 of the cylindrical shaft 44 from either of the tapered notches 40 to allow the blade 14 to change position.

Figure 3A:
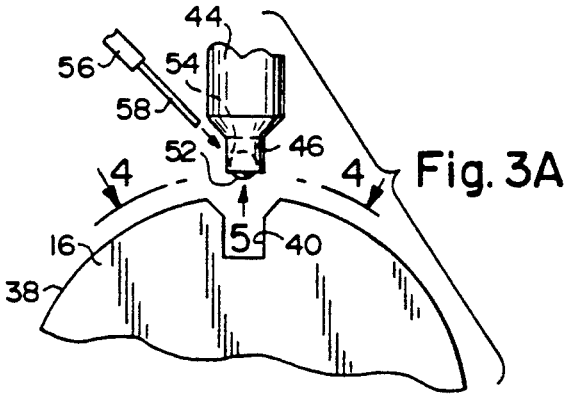
FIG. 3A is an enlarged elevational view similar to FIG. 3 of a portion of a second embodiment of the instant invention utilizing a teflon ball in a tapered open slot.
Figure 3:
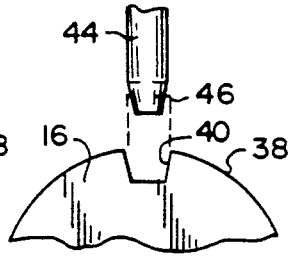
FIG. 3 is an enlarged diagrammatic elevational view with parts broken away as indicated by the dotted circle of arrow 3 in FIG. 1.
Figure 5:
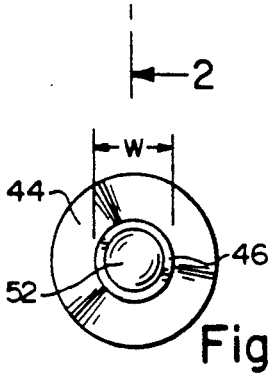
FIG. 5 is an enlarged view with parts broken away taken in the direction of arrow 5 in FIG. 3A.
Figure 4:
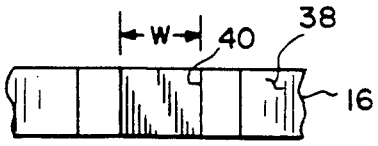
FIG. 4 is an enlarged view taken on curve 4—4 in FIG. 3A.

As shown in FIGS. 3 and 5, a teflon ball 52 can be either fixedly or rotative captured within the tapered end 46 of the cylindrical shaft 44. The cylindrical shaft 44 can also have a downwardly diagonal aperture 54, extending therein so as to permit access to the teflon ball 52 in the tapered end 46. A tool 56 is provided having a shaft 58 which fits through the downwardly diagonal aperture 54 to supply force to the surface of the teflon ball 52 as required to remove the teflon ball 52 for replacement when needed.

In operative use when a player desires to change the position of the blade 14 he/she simply release the mechanism 28 is for locking the blade and swings the stick in such a manner to cause the blade to rotate to the opposite position while simultaneously allowing the engaging mechanism 28 to lock the blade in the new position.

While certain novel features of this invention have been shown and described and are pointed out in the annexed claims, it will be understood that various omissions, device illustrated and in its operation can be made by those skilled in the art without departing from the spirit of the invention.

What is claimed is:

1. A hockey stick with an adjustable blade which comprises:

a) an elongated handle;

b) a blade extending from a heel end to a toe end with at least one puck engaging surface extending between said ends;

c) means for pivoting said heel end of said blade about a lower portion of said elongated handle, wherein said pivoting means includes:

i) said lower portion of said elongated handle having a bifurcated end; and ii) a pivot pin mounted between the furcations of said bifurcated end and the center of said heel end of said blade; and d) means for locking said blade in two angled opposite positions on said lower portion of said elongated handle, so that in a first instance said hockey stick can be used by both a right handed and a left handed hockey player and in a second instance a hockey player can make forehand and backhand puck striking shots from said at least one puck engaging surface of said blade, wherein said locking means includes:

i) said elongated handle having a central bore extending inwardly from said bifurcated end and a transverse slot communicating with said central bore;

ii) said heel end of said blade having a curved edge and two spaced apart tapered notches therein;

iii) an expansion spring placed within said central bore in said elongated handle;

iv) a cylindrical shaft having a tapered end placed within said central bore in said elongated handle, so that said expansion spring will bias said cylindrical shaft towards said heel end of said blade allowing the tapered end to ride on said curved edge and engage with either of said tapered notches;

v) a hand grip slideable on said elongated handle; and vi) a rod extending through said hand grip, said transverse slot in said elongated handle and said cylindrical shaft, so that the hockey player can slide said hand grip away from said heel end of said blade to release the tapered end of said cylindrical shaft from either of said tapered notches to allow said blade to change position.

2. A hockey stick with an adjustable blade as recited in claim 1, further including:

a) a teflon ball captured within said tapered end of said cylindrical shaft;

b) said cylindrical shaft having a downwardly diagonal aperture extending to said teflon ball in said tapered end; and c) a tool having a shaft which fits through said downwardly diagonal aperture to permit forcibly removing said teflon ball for replacement when needed.

* * * * *